US006733944B2

(12) United States Patent
Kadokura et al.

(10) Patent No.: US 6,733,944 B2
(45) Date of Patent: May 11, 2004

(54) IMAGE FORMING PROCESS

(75) Inventors: Yasuo Kadokura, Minamiashigara (JP); Masaaki Suwabe, Minamiashigara (JP); Shuji Sato, Minamiashigara (JP); Hiroshi Kamada, Minamiashigara (JP); Takao Ishiyama, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 35 days.

(21) Appl. No.: 10/218,661

(22) Filed: Aug. 15, 2002

(65) Prior Publication Data

US 2003/0039913 A1 Feb. 27, 2003

(30) Foreign Application Priority Data

Aug. 17, 2001 (JP) ..... 2001-248033

(51) Int. Cl.[7] ..... G03G 13/20

(52) U.S. Cl. ..... 430/124; 430/110.1; 430/110.3; 399/333; 399/330; 399/331; 399/329; 399/328

(58) Field of Search ..... 430/124, 110.3, 430/110.1; 399/333, 330, 331, 329, 328

(56) References Cited

U.S. PATENT DOCUMENTS 5,270,786 A * 12/1993 Kikuchi et al. ..... 399/286
5,612,160 A * 3/1997 Inoue et al. ..... 430/108.8
5,643,705 A * 7/1997 Inoue et al. ..... 430/108.8
5,998,080 A * 12/1999 Ohno et al. ..... 430/108.4
6,131,010 A * 10/2000 Kume et al. ..... 399/333
6,377,777 B1 * 4/2002 Kishino et al. ..... 399/329
6,391,510 B1 * 5/2002 Ishiyama et al. ..... 430/111.4
2002/0085866 A1 * 7/2002 Okayasu et al. ..... 399/328
2002/0125237 A1 * 9/2002 Ohno et al. ..... 219/216

FOREIGN PATENT DOCUMENTS

| | | |
|---|---|---|
| JP | 49-91231 | 8/1974 |
| JP | A 56-40868 | 4/1981 |
| JP | A 63-282749 | 11/1988 |
| JP | A 6-250439 | 9/1994 |

* cited by examiner

*Primary Examiner*—Christopher Rodee
(74) *Attorney, Agent, or Firm*—Oliff & Berridge, PLC

(57) ABSTRACT

The present invention provides an image forming process including the steps of: forming a latent image; developing the latent image with a toner to form a toner image; transferring the toner image onto a receiving body; and fixing the toner image to the receiving body, wherein the step of fixing is carried out using a fixing device including a heat-fixing roller, an endless belt, and a pressure member to allow the endless belt to travel around the heat-fixing roller at a given angle such that a nip is produced through which a recording sheet passes, with the pressure member being pressed to distort the heat-resistant elastic layer in the heat-fixing roller, and wherein the toner for developing the electrostatic latent image satisfies predetermined requirements.

20 Claims, 1 Drawing Sheet

IMAGE FORMING PROCESS

BACKGROUND OF THE INVENTION

1. Field of the Invention

The present invention relates to an image forming process in which an electrostatic latent image formed by an electrophotographic process, an electrostatic recording process or a similar process is developed with a developer.

2. Description of the Related Art

Methods of making image data visible through an electrostatic latent image, such as electrophotography, are currently used in various fields. In electrophotography, an electrostatic latent image is formed on the surface of a photoreceptor through charging and exposing steps, and the latent image is developed with a developer containing a toner, followed by transferring and fixing steps to make the developed image visible.

The developers used for the development can be divided into two-component developers composed of a toner and a carrier, and single-component developers only made of a magnetic toner or a non-magnetic toner. In order to prepare toner particles for producing a developer, a kneading and pulverizing process is ordinarily used in which a thermoplastic resin is melted and kneaded with a pigment, a charging modifier and a releasing agent such as wax, and the resultant mixture is cooled, pulverized into fine particles and then classified. To the toner particles produced by the kneading and pulverizing process are added, at the surfaces thereof, inorganic or organic fine particles, as necessary, for improving fluidity and cleanability.

The shape of the toner particles produced by the conventional kneading and pulverizing process is irregular and the surface composition thereof is not uniform. The shape and the surface composition of the toner particles vary depending on pulverability of the materials used and conditions of a pulverizing step. It is difficult to control the shape and the surface composition of the toner particles. Particularly if a material that is easily pulverizable is used to produce the toner particles, there are problems in that the particles produced are too minute or have altered shapes owing to a mechanical force such as a shear force generated in a developing device.

When a two-component developer is used, the above described incidences cause the finely-pulverized toner particles to firmly adhere to a carrier, whereby chargeability of the developer is accelerated to deteriorate. When a single-component developer is used, the above-described incidences provide a broader distribution in particle size. Therefore, toners become likely to scatter or developability is lowered due to a change in the shape of the toner particles, whereby image quality is frequently deteriorated.

In a case where the shape of the toner particles is irregular, the fluidity of the toner is insufficient even if an auxiliary for fluidizing toners is added to the toner. Consequently, while the toner is used, there arise problems in that, owing to a mechanical force such as a shear force, minute particles of the auxiliary fall into cavities of the toner particles, whereby the fluidity of the toner decreases with the passage of time, and developability, transferability and cleanability are impaired. If such a toner is the toner collected once or twice after cleaning and then returned to a developing device to be re-used, the quality of the image formed with the toner is further deteriorated. In order to prevent such incidences from occurring, it is conceivable to increase the amount of the auxiliary to be added. In this case, however, problems arise in that black spots may appear on the photoreceptor and the auxiliary may be scattered.

If a releasing agent such as wax is added inside the toner particle, the releasing agent frequently appears at the surface of the produced toner particles depending on the combination of a releasing agent and a thermoplastic resin. Particularly in the case where a resin that has elasticity due to a high molecular weight component and hence is slightly difficult to pulverize is combined with a brittle wax such as polyethylene, polyethylene frequently appears at the surface of the produced toner. The thus produced toner has poor releasing performance at the time of fixing and poor cleanability of non-transferred toner present on a photoreceptor. However, polyethylene appearing at the particle surface is released from the surface by a shear force generated in a developing device. As a result, polyethylene is easily transferred to a developing roll, a photoreceptor, a carrier and the like. Contamination caused by transferring degrades reliability as a developer.

Under these circumstances, attempts have been made in recent years to solve the above-described problems by controlling the shape and the surface composition of toner particles, and methods of producing toners in a wet manner have been intensely studied. For example, Japanese Patent Application Laid-Open (JP-A) Nos. 63-282749 and 6-250439 propose an emulsion polymerization aggregating process in which a dispersion of resin particles is prepared by emulsion polymerization while another dispersion is prepared in which a colorant is dispersed in an aqueous medium (solvent). Thereafter, the two solutions are mixed and heated to form aggregated particles whose particle size corresponds to a toner particle size, followed by further raising the temperature to effect coalescence of the aggregated particles, to finally produce a toner.

In recent years, high image quality has been increasingly demanded. Particularly in forming color images, trends are currently toward toner particles having a smaller and uniform size in order to achieve detail depiction. Generally, if a toner having a broad particle size distribution is used to form an image, toner particles belonging to a region of finer sizes in the distribution seriously cause contamination at a developing roll, a charging roll, a charging blade, a photoreceptor and a carrier, and also cause troublesome toner scattering. Accordingly, it is difficult to simultaneously achieve high image quality and high reliability. Further, the toner having a broad particle size distribution cannot yield high reliability in a system that has a cleaning function or a toner re-cycling function.

The toner having a finer particle size is likely to produce troubles particularly in a transferring step, to thus degrade high image quality. This is presumably attributed to the fact that an adhesive force of a toner to a photoreceptor, for example, a non-electrostatically adhesive force such as van der Waals force increases. In order to solve such a problem, it is necessary to adequately control an adhesive force between a toner and a photoreceptor, for example, by controlling the shape and the surface state of the toner particles.

As described above, it is very difficult to produce a toner having a very small and uniform particle size by employing a conventional kneading and pulverizing process. In principle, the smaller the particle size, the more the shape is distorted. Hence, it is impossible to avoid the above-described incidences from occurring in a transferring step. From the foregoing, an emulsion polymerization aggregating process has intensely been studied among wet toner-producing processes, since the process makes it possible to readily produce a toner having a very small and uniform particle size.

However, if toner particles are produced by employing an emulsion polymerization aggregating process, reaction usually progresses toward a goal, by applying heat, to make toner particles having irregular shapes to have a more smooth and spherical shape, that is, to make the particles to have a smaller surface area. Therefore, in principle, as the toner particles have a smaller particle size, the spherical degree thereof is higher (the surface area thereof is smaller); while as the toner particles have a larger particle size, the irregular degree of the shape is higher (the surface area thereof is larger). Moreover, in order to achieve all performances including transferability, transferring efficiency, cleanability and durability required of a toner, it is necessary to design the toner optimally.

For the above-described purpose, for example, JP-A No. 61-279864 proposes a potato-shaped toner in which toner shape coefficients SF1 and SF2 are specified within a range of 120 to 180 and within a range of 110 to 130, respectively, in which SF1 (an index representing toner distortion={[(maximum length)$^2$/(projected area)]×(π/4)×100} and SF2 (an index representing surface roughness)={[(circumferential length)$^2$/(projected area)]×(¼π)×100}. However, when the thus obtained toner is used for oil-less fixing, a problem associated with fixing stability arises, whereby offset phenomena occasionally arise when a large number of sheets are copied.

The particle size distribution of a toner may mainly be affected by rupture of the toner by a mechanical force. Further, if a toner has an initial broad particle size distribution, granular selectivity during development, scattering during transfer and cleanability are adversely affected. In addition, if a toner has a broad particle size distribution, contamination frequently occur at a developing roll, a charging roll and a charging blade during development when a single-component developer is used.

In order to control variation in the shape of toner particles, it is necessary to narrow a distribution at both sides of a small particle size region and a large particle size region. Toner particles can be compared with each other with respect to a particle size distribution, using indexes designated as GSD each for a volume average and a number average. The volume average GSD (GSDv) and the number average GSD (GSDp) can be used as an index representing a proportion at a large particle size and as an index representing a proportion at a small particle size, respectively. It is particularly preferable to use GSDp-under as an index representing a proportion at a small particle size.

In view of developability and/or transferability, toner particles belonging to a small particle size have a strong adhesive force, as have been already known. Therefore, it is difficult to electrostatically control such particles, and such particles are likely to remain on a carrier when a two-component developer is used. If a mechanical force is repeatedly applied, carrier contamination is caused to promote carrier deterioration. Since toner particles having a small particle size have a strong adhesive force, developing efficiency decreases thus leading to defective image quality. In transferring step, among the whole toner particles developed, the particles belonging to a smaller size region are difficult in being transferred onto a photoreceptor. As a result, transferring efficiency decreases, whereby the amount of toner waste increases and image quality degrades.

On the other hand, the toner particles belonging to a large particle size region, although having a weak adhesive force, are likely to produce an uneven gap in transferring step or easily being scattered to a non-image area. Thus, the particles are largely associated with a decrease in image quality. Furthermore, as the particles are likely to scatter at the time of development, a decrease in reliability due to contamination inside the device is liable to occur. In a case where the toner shape is made close to a sphere to achieve high transferring efficiency, the aforementioned incidences become even more pronounced.

Toners undergo various stresses in the process of electrophotography. In order to obtain stable toner performances, it is necessary to control not only the shape and the particle size of a toner but also to hinder a releasing agent from appearing at the surface of the toner.

In general, when a kneading and pulverizing process is employed, an exposure ratio of the releasing agent at the toner surface is as high as 40%. Although such a high ratio favorably affects fixing performances such as prevention of offset phenomena from occurring at high temperatures, it is difficult to maintain charging properties over a long period of time, or it is apt to undesirably produce a black spot by adhesion of the releasing agent to a carrier or a photoreceptor. If the ratio is small, there arise problems mainly associated with decreased reliability of fixing performances, such as occurrence of offset phenomena at high temperatures or the lowered fixed image strength at low temperatures.

Usually, in order to fix to a receiving body an unfixed toner image which has been formed using the above-described toner, a heat-fixing method is widely used, in which a toner is melted by heating to cause thermal fusion.

As the heat-fixing method, heat-fixing is widely employed in which a recording medium having formed thereon an unfixed toner image is passed through two rollers, one being a heat-fixing roller having a built-in heating source and the other being a pressure roller capable of pressing a passing material against a counter roller, to thereby fuse and fix the toner onto the recording medium.

In the above-described heat-fixing, however, the heat-fixing roller must be coated with an elastic layer having a relatively large thickness or the elastic layer must be coated with a releasing layer in order to obtain high image quality or high fixing performances. Since it takes a long time for the heat-fixing roller to warm up, heat-fixing is not preferable from the viewpoint of saving energy.

SUMMARY OF THE INVENTION

The present invention was devised to overcome the above-described problems of prior art toners.

1. An object of the invention is to provide an image forming process which has excellent properties such as chargeability, developability, transferability, fixing properties, and particularly cleanability, satisfies high image quality, high reliability and sufficient maintaining ability, and makes it possible to stably perform instant-on fixing.
2. Another object of the invention is to provide an image forming process with which it is possible to produce a high quality image having excellent light transmission and colorability.

The means to attain the above-described objects are as follows.

A first aspect of the invention is an image forming process comprising the steps of: forming a latent image on a surface of an electrostatic latent image-bearing body; developing the latent image with a toner for developing an electrostatic latent image to form a toner image; transferring the toner image onto a receiving body; and fixing the toner image to the receiving body, wherein the step of fixing is carried out using a fixing device comprising a heat-fixing roller in which a heat-resistant elastic layer is provided on a cylindrical core metal and the resultant surface thereof is further provided with a heat-resistant resin layer, an endless belt, and a pressure member arranged inside the endless belt to allow the endless belt to travel around the heat-fixing roller at a given angle such that a nip is produced through which a recording sheet (the receiving body) passes, with the pressure member being pressed via the endless belt against the heat-fixing roller at the nip to thereby distort the heat-resistant elastic layer in the heat-fixing roller, and the toner for developing the electrostatic latent image satisfies the requirements of: a) a shape coefficient SF1 ranges from 125 to 140 and a shape coefficient SF2 ranges from 105 to 130, wherein $SF1=(\pi/4)\times(L^2/A)\times 100$ and $SF2=(\frac{1}{4}\pi)\times(I^2/A)\times 100$, in which L represents a maximum length, I represents a circumferential length and A represents a projected area of toner particles; b) an exposure ratio of a releasing agent at the surface of the toner particles determined by X-ray photoelectron spectroscopy (XPS) ranges from 11 to 40%; and c) a melting point of the releasing agent contained at 8 to 20% by mass in the toner, measured with a differential scanning calorimeter, ranges from 70 to 130° C., and the size of the releasing agent determined at a cross section of the toner particle observed with a transmission electron microscope ranges from 150 to 1500 nm.

That is, by providing the heat-resistant elastic layer of the heat-fixing roller with the heat-resistant resin layer as the releasing layer and distorting the heat-fixing roller, high image quality can be achieved without using a releasing agent such as silicone oil while maintaining a high releasing property. The releasing property of the heat-resistant resin does not deteriorate easily, and it is possible to maintain the releasing property over a long period of time. Since the endless belt is wound around the heat-fixing roller to produce a nip, a larger nip can be obtained with merely a low load applied as compared to a nip obtained in a fixing method using a pair of rollers. Thus, stiffness of the core metal of the fixing roller can be decreased, and additionally the heat-resistant elastic layer of the heat-fixing roller may be thinned. Thus, instant-start ability can be improved. Since a load applied to a nip can be reduced, the wear of a heat-resistant resin layer can be considerably decreased.

If the shape coefficient SF1 of the toner exceeds 140, the fluidity of the toner decreases, whereby transferability of the toner is adversely affected from an initial stage. If the shape coefficient SF1 is below 125, insufficient cleaning may occur to cause contamination of the apparatus or a decrease in reliability. If the shape coefficient SF2 is below 105, insufficient cleaning may occur, which easily causes contamination of the apparatus or a decrease in reliability. If the shape coefficient SF2 exceeds 130, the fluidity of the toner is likely to decrease.

The shape coefficient of the toner is obtained as follows. The toner is sprayed onto a slide glass, and then an image is observed with an optical microscope and information of the image is sent through a video camera to a Luzex image analyzer. The maximum length and the projected area of each of over 1,000 toner particles are measured, and the obtained values are substituted for the variables in the above-described equations. The average values thereof are used as the shape coefficient.

If the ratio of the releasing agent appearing (exposed) at the toner surface is below 11%, the fixing performance is not affected at an initial stage, however, the maintaining ability may occasionally be affected over a long period of time. If the fixing device deteriorates, offset phenomena at high temperatures and fixed-image strength at low temperatures may sometimes be affected. On the other hand, if the ratio is over 40%, the fixing performance is not affected but filming may occur in the carrier, a developing roller and a photoreceptor. Moreover, such a phenomenon easily occurs where an externally added additive for imparting fluidity to the toner penetrates the toner. The surface exposure ratio can be determined, using a measuring instrument such as an X-ray photoelectron spectrometer (XPS) manufactured by JEOL. Ltd. which is capable of distinguishing the peaks obtained from the resin, the pigment and the wax.

The addition amount of the above-described releasing agent preferably ranges from 8 to 20% by mass. If the amount is smaller than this range, sufficient releasing property cannot be obtained, leading to insufficient releasing. If the amount is larger than the above-described range, light transmission after fixing the toner to the resin sheet is affected, thus impairing resin sheet adaptability and initial chargeability of the toner.

Furthermore, the size of the releasing agent at a cross section of the toner particles observed with a transmission electron microscope preferably ranges from 150 to 1500 nm. If the size of the releasing agent is smaller than this range, the releasing agent does not act well, thus failing to produce a sufficient releasing property. If the size is larger than the above-described range, light transmission after fixing the toner to the resin sheet is affected, thus impairing resin sheet adaptability.

The releasing agent preferably has a melting point, whose main maximum peak measured according to ASTMD 3418-8 lies within a range of 70 to 130° C. If the peak occurs below 70° C., offset phenomena easily take place at the time of fixing the toner. If the peak occurs over 130° C., fixing temperature becomes high so that the surface of the fixed image cannot become smooth, to thus impair gloss. The main maximum peak is measured using, for example, DSC-7 manufactured by PerkinElmer Japan Co., Ltd. For temperature correction at a temperature sensing portion of the device, the melting points of indium and zinc are used. For calorie correction, the heat of fusion of indium is used. Measurements are conducted using a pan made of aluminum for a sample while a blank pan for a control, at a temperature-elevating rate of to 10° C./minute.

According to the present invention having a characteristic feature of combining the above-described fixing device and the specified toner to form an image, instant-on fixing can be satisfactorily achieved and additionally high image quality can be maintained on a large number of sheets. Furthermore, according to the invention, an image excellent in light transmission and colorability can be obtained.

A second aspect of the invention is an image forming process in which the thickness of a heat-resistant elastic layer ranges from 0.2 mm to 1.0 mm.

In the invention, the thickness of a heat-resistant elastic layer preferably ranges from 0.2 mm to 1.0 mm. When the elastic layer having a lower heat conductivity than metals is thick, conduction of heat is slow even if the inside of the layer is heated. Therefore, a thick layer may prevent the high-speed operation of a fixing device. In the invention, the duration for the fixing device to be heated to 180° C. is desirably 60 seconds or less. If the duration for the temperature of the device to reach 180° C. is over 60 seconds, instant-start ability is poor and advantages of the toner used in the invention cannot sufficiently provided.

In the invention, the heat-resistant resin layer is desirably made of a fluorine-containing resin. The fluorine-containing resin has an excellent releasing property which does not easily deteriorate with the passing of time. Hence, the fluorine-containing resin renders the life span of the fixing device longer. Examples of the fluorine-containing resin include polytetrafluoroethylene (hereinafter referred to as "PTFE"), perfluoroalkyl vinyl ether copolymer (hereinafter referred to as "PFA"), tetrafluoroethylene hexafluoropropylene copolymer (hereinafter referred to as "FEP").

In the invention, the thickness of a heat-resistant resin layer in the heat fixing roller preferably ranges from 10 to 50 μm. By making the heat-resistant resin layer thin, the heat-resistant elastic layer is effectively distorted at the nip, to thus improve the releasing property.

A third aspect of the invention is an image forming process in which the distortion is expressed by the magnitude of a nip width of 3 to 12 mm of the elastic layer in the heat-fixing roller.

In the invention, a pressure pad is used as the pressure member, and a nip width between a heat fixing roller and an endless belt, which is produced with a pressure pad, desirably ranges from 3 to 12 mm. If a pressure pad is used as the pressure member, the device can be made small-sized. If the nip width is smaller than the above-described range, sufficient heat and pressure cannot be applied to the receiving body so that sufficient fixing performance may not be obtained. If the nip width is larger than the above-described range, the endurance of the heat fixing roller or the traveling ability of the receiving body is undesirably impaired.

In the invention, it is preferable that a nip pressure generated when the pressure pad presses the heat-fixing roller is locally increased in the vicinity of the outlet of a nip. If the distortion of the fixing roller is enlarged locally in the vicinity of the outlet of a nip, a higher releasing property can be obtained with a smaller distortion as compared with the case of generating distortion over an entire nip as obtained by a fixing method using a pair of rollers. Accordingly, wrinkles can be prevented from being generated even when a thin heat-resistant resin layer is formed on the surface of a heat-fixing roller. Further peeling of the heat-resistant elastic layer from the releasing layer made of the heat-resistant resin does not easily occur, to thereby maintain a high releasing performance and reliability over a long period of time. Moreover, since the distortion magnitude is small, the heat-resistant elastic layer in the fixing roller can be thinned. Since this fact contributes to reduce the heat capacity of a fixing roller, instant-start ability can be further improved and power consumption can also be reduced. Since the heat-resistant elastic layer having a low thermal conductivity can be made thin, heat resistance between an inner face and an outer face of the fixing roller can be decreased so that the heat response may be facilitated. Thus, a swift fixation can be attained. Since the distortion magnitude is small, the wear of a heat-resistant resin can be reduced.

In the invention, the total pressing force exerted by the pressure pad is desirably 60 kg or less. If the pressing force is high, wrinkles may be generated when a thin heat-resistant resin layer is provided on the surface of the heat-fixing roller. As a result, the endurance of the heat-fixing roller significantly decreases. Further, the heat-resistant elastic layer may undesirably be peeled from the releasing layer made of the heat-resistant resin and hence the heat-resistant resin may easily be worn. Thus, the releasing performance cannot be maintained over a long period of time, to thereby degrade reliability. Moreover, the heat-resistant elastic layer of the fixing roller cannot be thinned, failing to readily achieve instant-start ability.

A fourth aspect of the invention is an image forming process in which the toner further satisfies the requirements of: d) an average volume particle size distribution index $GSDv \leqq 1.25$, wherein $GSDv=(D84v/D16v)^{1/2}$, in which D84v is a particle size value at which accumulated volume from the side of a smaller particle size in the volume particle size distribution accounts for 84% and D16v is a particle size value at which accumulated volume from the side of a smaller particle size in the volume particle size distribution accounts for 16%; e) an average number particle size distribution index $GSDp \leqq 1.25$, wherein $GSDp=(D84p/D16p)^{1/2}$, in which D84p is a particle size value at which accumulated number from the side of a smaller particle size in the number particle size distribution accounts for 84% and D16p is a particle size value at which accumulated number from the side of a smaller particle size in the number particle size distribution accounts for 16%; f) a small particle size side number particle size distribution index GSDp-under$\leqq$1.27, wherein GSDp-under=(D50p/D16p), in which D50p is a particle size value at which accumulated number from the side of a smaller particle size in the number particle size distribution accounts for 50% and D16p is a particle size value at which accumulated number from the side of a smaller particle size in the number particle size distribution accounts for 16%; and g) inclusion of minute particles made of two or more kinds of silicon compounds, each having a central particle size of 5 to 30 nm and 30 to 100 nm, at 0.5 to 10% by mass.

If the average volume particle size distribution index GSDv is more than 1.25, both sharpness and resolution of images deteriorate. If the average number particle size distribution index GSDp is more than 1.25, transferability decreases from an initial stage to thereby degrade image quality. Specifically, if the small particle size side number particle size distribution index GSDp-under is more than 1.27, the proportion of small particle size toner particles becomes high, whereby the initial performance and reliability are significantly affected. In other words, as has been already known, since toner particles having a small size have a strong adhesive force, it is difficult to electrostatically control such particles, whereby such particles are likely to remain on a carrier if a two-component developer is used. When a mechanical force is repeatedly applied to the toners, carrier contamination frequently occurs to promote carrier deterioration. Since the small particle size toner particles have a strong adhesive force, developing efficiency also decreases, thus leading to defective images. In the transferring step, it is difficult to transfer small particle size particles, among the toner particles developed, onto a photoreceptor, resulting in a decrease in transferability, whereby the amount of toner waste increases and image quality degrades.

If the average volume particle size D50v is less than 3 μm, cleanability becomes insufficient to thereby impair developability. If the size D50v is more than 7 μm, the resolution of images easily deteriorates.

Examples of the minute particles of silicon compound include silica, hydrophobic silica, colloidal silica, cation surface-treated colloidal silica and anion surface-treated colloidal silica. These inorganic minute particles have undergone dispersing treatment beforehand in the presence of an ionic surfactant using an ultrasonic dispersing machine. Colloidal silica is preferably used since it does not need to undergo such a dispersing treatment.

If the addition amount of the silicon compound minute particles is less than 0.5% by mass, a sufficient toughness cannot be obtained when the toner is melted. Thus, the releasing property in an oil-less fixation cannot be improved and oil-less releasing property may be damaged since coarse dispersibility of the minute particles in the toner causes increased viscosity when the toner is melted, to thus impair spinning ability. If the addition amount is more than 10% by mass, a sufficient toughness can be obtained but the fluidity of the toner when melted decreases significantly to thereby impair gloss of images.

In the invention, the process preferably comprises steps of admixing a dispersion containing at least resin fine particles having a particle size of at least 1 $\mu$m or less, with a dispersion of colorant particles, a dispersion of a releasing agent and a dispersion of inorganic minute particles, to prepare a dispersion of aggregated particles of resin fine particles and colorant particles, and thereafter heating the thus prepared dispersion to a temperature above the glass transition point of the resin fine particles to cause fusion or coalescence. In the aggregating step, at least one polymerized metal salt is used.

A fifth aspect of the invention is an image forming process in which the developing step is performed using a developer for developing an electrostatic latent image comprising a carrier and a toner for developing an electrostatic latent image.

A sixth aspect of the invention is an image forming process in which a toner is produced by a process comprising steps of admixing a dispersion containing at least resin fine particles having a particle size of 1 $\mu$m or less, with a dispersion of colorant particles and a dispersion of a releasing agent to prepare a dispersion of aggregated particles, and thereafter heating the thus prepared dispersion to a temperature above the glass transition point of the resin fine particles.

DESCRIPTION OF THE PREFERRED EMBODIMENTS

Toner

Figure 1:
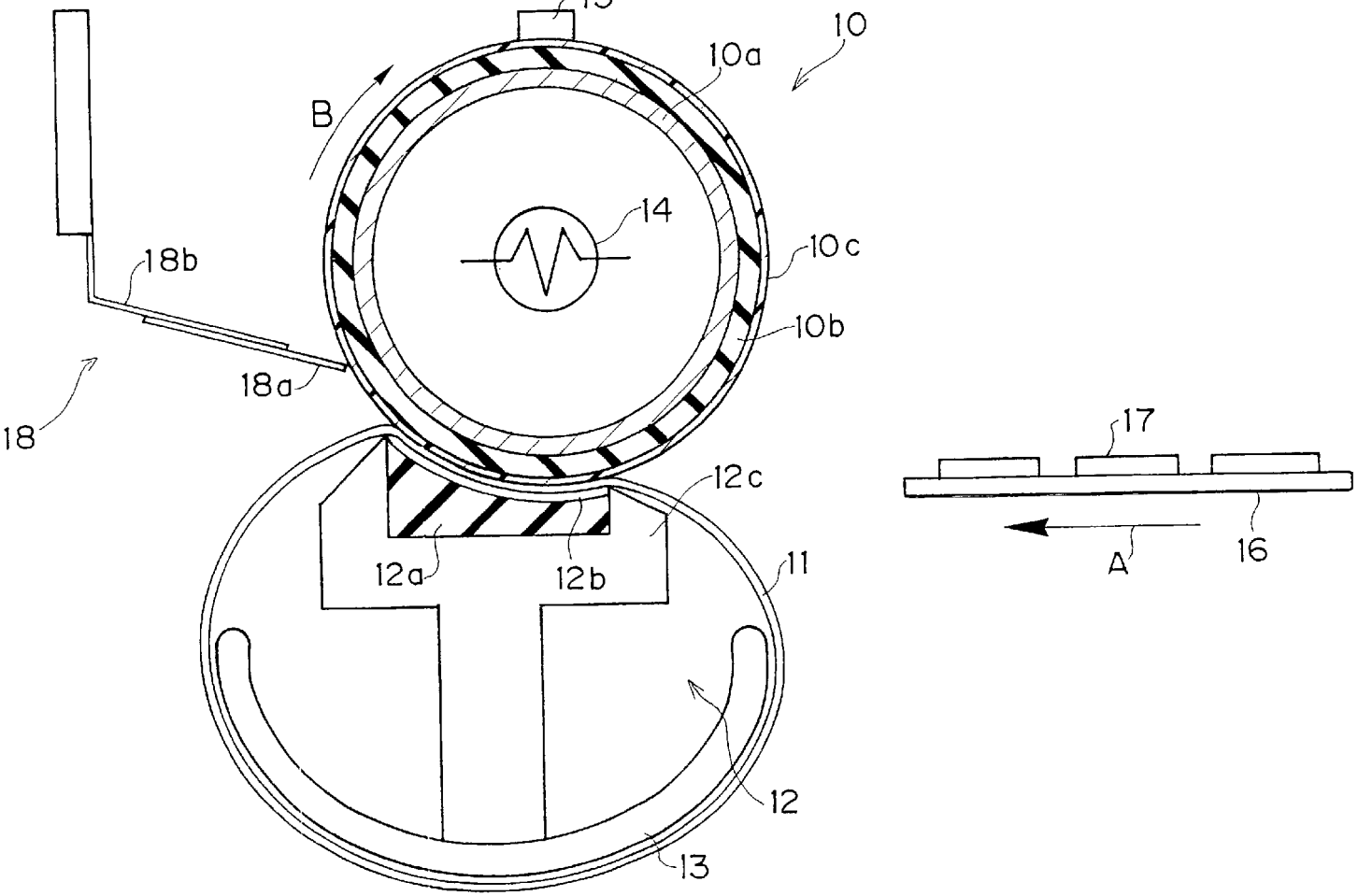
FIG. 1 is a side sectional view of a fixing device used in the present invention.

The toner for developing an electrostatic latent image used in the present invention is produced by a process comprising: a first step of preparing a dispersion of aggregated particles by causing aggregation in the dispersion containing at least resin particles (aggregating step); a second step of admixing a dispersion of fine particles with the dispersion of the aggregated particles to adhere the fine particles to the aggregated particles to thereby form particles adhered by the fine particles (adhering step); and a third step of heating the resultant particles to cause fusion or coalescence (coalescence step).

It is desirable that the second step is performed a plural number of times. The second step is preferably performed by admixing a dispersion of releasing agent fine particles with the dispersion of the aggregated particles to adhere the releasing agent fine particles to the aggregated particles to form particles adhered by the fine particles, followed by adding the dispersion of resin fine particles to thereby form particles adhered by resin fine particles.

Further, the second step is preferably conducted by admixing a dispersion of colorant fine particles with the dispersion of the aggregated particles to adhere the colorant fine particles to the aggregated particles to form particles adhered by the fine particles, followed by adding the dispersion of resin fine particles to thereby form particles adhered by the resin fine particles.

Still further, the second step is preferably conducted by admixing a dispersion of resin fine particles with the dispersion of the aggregated particles to adhere the resin fine particles to the aggregated particles to form particles adhered by the resin fine particles, followed by adding a dispersion of inorganic minute particles to thereby form particles adhered by the inorganic minute particles.

In the second step, the dispersion of aggregated particles prepared in a first step is admixed with a dispersion of fine particles to adhere the fine particles to the aggregated particles to thereby form particles adhered by the fine particles. Since such fine particles are additional particles distinguishable from the aggregated particles, the fine particles are sometimes referred to as "additional particles".

The method of adding a dispersion of the fine particles is not particularly limited. For example, the addition may be conducted slowly and continuously, or may be divided into plural operations so as to be stepwise performed. By adding the fine particles (additional particles) in this way, the generation of very fine particles is suppressed and a particle size distribution of the resultant toner for developing an electrostatic latent image can be made sharp. When the addition is divided into plural operations so as to be stepwise performed, the fine particles are multi-laminated on the surface of the aggregated particles, to thereby alter the structure or generate a composition gradient from inside to outside of the toner particle for developing an electrostatic latent image, whereby the surface hardness of the particle is improved. Moreover, at the time of fusing particles in the third step, the particle size distribution can be maintained and variation thereof can be suppressed. Furthermore, addition of surfactants for improving stability and stabilizers such as a base or an acid can be eliminated, or the addition amount thereof can be reduced as small as possible, thus providing advantages of reduced costs and improved quality.

Examples of polymers for use as the thermoplastic binder resin in the resin fine particles include monomers selected from styrenes such as styrene, p-chlorostyrene and $\alpha$-methylstyrene; vinyl group-containing esters such as methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate and 2-ethylhexyl methacrylate; vinylnitriles such as acrylonitrile and methacrylonitrile; vinyl ethers such as vinyl methyl ether and vinyl isobutyl ether; vinyl ketones such as vinyl methyl ketone, vinyl ethyl ketone and vinyl isopropyl ketone; polyolefins such as ethylene, propylene and butadiene; the polymers thereof; the copolymers made from two or more kinds thereof; the mixtures thereof; and further epoxy resins, polyester resins; polyurethane resins; polyamide resins; cellulose resins; polyether resins; non-vinyl condensed resins; mixtures of one or more of these resins and one or more of vinyl resins; and graft polymers obtained when a vinyl monomer is polymerized in the presence of one or more of these resins. These resins may be used singly or in combination of two or more thereof.

Among the above-listed resins, the vinyl resins are particularly preferable. It is advantageous to use the vinyl resins since a dispersion of resin particles can readily be prepared by causing emulsion polymerization or seed polymerization using an ionic surfactant or the like.

The method of preparing a dispersion of resin particles is not particularly limited and can be suitably adopted depending on the purposes. For example, the dispersion can be prepared as follows.

If the resin in the resin particles is a homopolymer or a copolymer of vinyl monomers, e.g., vinyl group-containing esters, vinylnitriles, vinyl ethers and vinyl ketones (i.e., vinyl-based resins), then a dispersion of resin particles in which resin particles made of the homopolymer or the copolymer of the vinyl monomers are dispersed in an ionic surfactant can be prepared by causing emulsion polymerization or seed polymerization of the vinyl monomer in the ionic surfactant.

If the resin in the resin particles is a resin other than the homopolymer or the copolymer of the above-described vinyl monomers and if the resin can be dissolved in an oily solvent having a relatively low solubility in water, then a dispersion can be prepared by dissolving the resin in the oily solvent, adding the resultant mixture to water together with the ionic surfactant and a high-molecular electrolyte, dispersing fine particles using a dispersing device such as a homogenizer, followed by heating or decompressing to evaporate off the oily solvent.

If the resin particles dispersed in a dispersion of resin particles are composite particles containing other components than the resin particles, then a dispersion of the composite particles can be prepared as follows. For example, the dispersion can be prepared in such a manner that respective components of the composite particles are dissolved or dispersed in a solvent, the resultant mixture is dispersed in water together with a suitable dispersing agent as described above followed by heating or decompressing to remove the solvent, or in such a manner that the surface of a latex produced by emulsion polymerization or seed polymerization is subjected to mechanical shearing or electrical adsorption to be fixed.

The average particle size of the resin particles is preferably 1 $\mu$m or less, more desirably ranges from 0.01 to 1 $\mu$m. If the average particle size of the resin particles is more than 1 $\mu$m, a particle size distribution of the finally-produced toner for developing an electrostatic latent image becomes broad or free particles are produced to impair performances or reliability. In contrast, if the average particle size of the resin particles is within the above-described range, the toner does not have the above-described drawbacks, and variation between the toners decreases, whereby the resin particles are sufficiently dispersed in the toner, thus providing an advantage of reduced variation of performances or reliability. The average particle size of the resin particles can be measured using, e.g., a microtrack, etc.

If the resin in the resin particles is a resin other than the homopolymer of the copolymer of the vinyl monomers and if the resin is dissolved in an oily solvent having a relatively low solubility in water, then a dispersion can be prepared by dissolving the resin in the oily solvent, adding the resultant mixture to water together with an ionic surfactant or a high-molecular electrolyte, dispersing fine particles using a dispersing device such as a homogenizer, followed by heating or decompressing to evaporate off the oily solvent.

Examples of the colorant include various pigments such as carbon black, chrome yellow, Hansa yellow, benzidine yellow, threne yellow, quinoline yellow, Permanent orange GTR, pyrrazolone orange, Vulcan orange, Watchung red, Permanent red, Brilliant carmine 3B, Brilliant carmine 6B, Dupont oil red, pyrrazolone red, Lithol red, Rhodamine B lake, Lake red C, rose bengal, aniline blue, ultramarine blue, Calco oil blue, methylene blue chloride, phthalocyanine blue, phthalocyanine green and malachite green oxalate; and various dyes such as acridine, xanthene, azo, benzoquinone, azine, anthraquinone, dioxazine, thiazine, azomethine, indigo, thioindigo, phthalocyanine, aniline black, polymethine, triphenylmethane, diphenylmethane and thiazole dyes. These colorants may be used singly or in combination of two or more kinds thereof. In the case of the latter, the color of the toner can arbitrarily be adjusted by changing the kinds of the colorants (pigments), or the blending ratio thereof. The dispersion of colorant particles can be prepared, for example, by dispersing the colorant particles in an aqueous medium made of the above-described surfactant or the like.

The average particle size of the colorant particles used in the invention is preferably 0.8 $\mu$m or less, more preferably ranges from 0.05 to 0.5 $\mu$m. If the average particle size of the colorant particles is over 0.8 $\mu$m, a particle size distribution in the finally-produced toner for developing an electrostatic latent image becomes broad or free particles are produced, to thus impair performances or reliability. If the average particle size of the colorant particles is less than 0.05 $\mu$m, the colorability thereof in the toner is impaired and further shape-controllability, which is one of characteristics of the emulsifying aggregation method, is damaged to thus fail to produce a truly spherical shape.

The number ratio of the particles having a size over 0.8 $\mu$m is preferably less than 10%, more preferably 0%. If such large-sized particles are present, the stability in the aggregating step is affected, leading to production of free large-sized colorant particles and a broad particle size distribution. The number ratio of the particles having a size below 0.05 $\mu$m is preferably 5% or less. If such small-sized particles are present, the shape-controllability in the coalescence step is affected, failing to produce smooth particles having the shape coefficient SF1 of 130 or less. In contrast, if the average particle size, the number ratio of the large-sized particles, and that of the small-sized particles of the colorant particles are within the above-described ranges, the toner does not have the above-described drawbacks and variation between the toners decreases, whereby the colorant particles are satisfactorily dispersed in the toner, thus providing an advantage of reduced variation of performances or reliability. The average particle size of the resin particles can be measured using, e.g., a microtrack, etc. The addition amount of the colorant is preferably set within a range of 1 to 20% by mass of the toner particles.

In the invention, the colorant may be surface-modified with rosin, polymer or the like.

The surface-modified colorant particles are sufficiently stable in a dispersion of the colorant. Thus, after the colorant has been dispersed in the dispersion so as to have a desired average particle size, colorant particles do not cause aggregation when the dispersion of the colorant is admixed with the dispersion of resin particles or during the aggregating step, whereby a good dispersibility can be favorably maintained. In contrast, the excessively surface-modified colorant particles do not aggregate with the resin particles during the aggregating step and hence the particles may be freed. Therefore, the surface-modification is carried out under optimally selected conditions.

Examples of the polymer include acrylonitrile polymer or methyl methacrylate polymer.

In order to surface-modify the colorant particles, a polymerization method in which a monomer is polymerized in the presence of the colorant (pigment), or a phase separation method in which a colorant (pigment) is dispersed in a solution of a polymer and the solubility of the polymer is lowered to deposit the polymer on the surface of the colorant (pigment) is employed.

A dispersion in which an additional component (particle), for example, a releasing agent or an additive to be added to the interior of the particle is dispersed can be prepared in the following manner. For example, if the additional component is the releasing agent, the releasing agent is dispersed in water together with an ionic surfactant or a high-molecular electrolyte such as a high-molecular acid or a high-molecular base. Dispersing can be conducted by applying a strong shear force using a homogenizer or a pressure jet type dispersing device, with heating the dispersion to a temperature above the melting point of the releasing agent, to make the releasing agent pulverized into fine particles. In a case where the additional component (particle) is an inorganic powder or the like, the dispersion can be prepared by dispersing the inorganic powder or the like into an aqueous medium made of the above-described surfactant or the like.

Examples of the releasing agent include low molecular weight polyolefins such as polyethylene, polypropylene and polybutene; silicones having a softening point acquired by heating; aliphatic acid amides such as oleic acid amide, erucic acid amide, ricinolic acid amide and stearic acid amide; vegetable waxes such as carnauba wax, rice wax, candelilla wax, Japan wax and jojoba oil; animal waxes such as beeswax; minerals and petroleum waxes such as montan wax, ozocerite, ceresin, paraffin wax, microcrystalline wax and Fischer-Tropsh wax, and the modified products thereof. These releasing agents may be used singly or in combination of two or more kinds thereof.

The average particle size of the above-described additional component (particle) is preferably 1 $\mu$m or less, more preferably ranges from 0.01 to 1 $\mu$m. If the average particle size is more than 1 $\mu$m, a particle size distribution of the finally-produced toner for developing an electrostatic latent image becomes broad or free particles are produced to impair performances or reliability. In contrast, if the average particle size of the resin particles is within the above-described range, the toner does not have the above-described drawbacks and variation between the toners decreases, whereby the resin particles are satisfactorily dispersed in the toner, thus providing an advantage of reduced variation of performances or reliability. The average particle size of the resin particles can be measured using, e.g., a microtrack, etc.

For use as the dispersing medium to prepare the dispersion of the resin particles, the colorant particles and the additional component (particle), for example, an aqueous medium may be mentioned. Examples of the aqueous medium include water, e.g., distilled water and ion exchange water, and alcohols. These may be used alone or in combination of two or more thereof.

The means for preparing a variety of dispersions are not particularly limited. Examples thereof include a rotary shearing homogenizer; a ball mill, a sand mill and a Dyno mill each having a medium; and other conventionally known dispersing devices.

In the invention, any one of various charging modifiers that are ordinarily used, for example, quaternary ammonium salt compounds, nigrosine compounds, dyes made of complexes comprising aluminum, iron, chromium or the like, and triphenyl methane pigments are used. From the viewpoints of controlling ion strength that affects stability of aggregation or coalescence and reducing the amount of contaminated waste water, materials having low solubility in water are preferably used.

In the invention, it is preferable to admix a surfactant with the aqueous medium.

Preferable examples of the surfactant include anionic surfactants such as sulfate, sulfonate, phosphate and soap surfactants; cationic surfactants such as amine salt and quaternary ammonium salt surfactants; and nonionic surfactants such as polyethylene glycol, alkylphenol ethyleneoxide adduct and polyhydric alcohol surfactants. Among these surfactants, the ionic surfactants are preferable, and the anionic surfactants and the cationic surfactants are more preferable. The nonionic surfactant is preferably used in combination with an anionic surfactant or a cationic surfactant. The surfactants may be used singly or in combination of two or more thereof.

Specific examples of the anionic surfactant include aliphatic acid soaps such as potassium laurate, sodium oleate and sodium castor oil; sulfates such as octyl sulfate, lauryl sulfate, lauryl ether sulfate and nonyl phenyl ether sulfate; sulfonates such as lauryl sulfonate, dodecyl sulfonate, dodecylbenzenesulfonate, triisopropylnaphthalenesulfonate, sodium alkylnaphthalenesulfonate such as dibutylnaphthalenesulfonate, naphthalenesulfonate formalin condensates, monooctylsulfosuccinate, dioctylsulfosuccinate, lauric amide sulfonate and oleic amide sulfonate; phosphates such as lauryl phosphate, isopropyl phosphate and nonyl phenyl ether phosphate; and sulfosuccinates such as sodium dialkylsulfosuccinate, e.g., sodium dioctylsulfosucccinate, lauryl disodium sulfosuccinate and lauryl disodium polyoxyethylenesulfosuccinate.

Specific examples of the cationic surfactant include amine salts such as laurylamine hydrochlorate, stearylamine hydrochlorate, oleylamine acetate, stearylamine acetate and stearylaminopropylamine acetate; and quaternary ammonium salts such as lauryltrimethylammonium chloride, dilauryldimethylammonium chloride, distearyammonium chloride, distearyldimethylammonium chloride, lauryldihydroxyethylmethylammonium chloride, oleylbispolyoxyethylenemethylammonium chloride, lauroylaminopropyldimethylethylammonium ethosulfate, lauroylaminopropyldimethylhydroxyethylammonium perchlorate, alkylbenzenedimethylammonium chloride and alkyltrimethylammonium chloride.

Specific examples of the nonionic surfactant include alkyl ethers such as polyoxyethylene octyl ether, polyoxyethylene lauryl ether, polyoxyethylene stearyl ether and polyoxyethylene oleyl ether; alkyl phenyl ethers such as polyoxyethylene octylphenyl ether and polyoxyethylene nonylphenyl ether; alkylesters such as polyoxyethylene laurate, polyoxyethylene stearate and polyoxyethylene oleate; alkylamines such as polyoxyethylene laurylamino ether, polyoxyethylene stearylamino ether, polyoxyethylene oleylamino ether, polyoxyethylene soybean aminoether and polyoxyethylene beef tallow aminoether; alkylamides such as polyoxyethylene lauric amide, polyoxyethylene stearic amide and polyoxyethyleneoleic amide; vegetable oil ethers such as polyoxyethylene castor oil ether and polyoxyethylene rapeseed oil ether; alkanol amides such as lauric acid diethanol amide, stearic acid diethanol amide and oleic acid diethanol amide; and sorbitan ester ethers such as polyoxyethylene sorbitan monolaurate, polyoxyethylene sorbitan monopalmitate, polyoxyethylene sorbitan monostearate and polyoxyethylene sorbitan monooleate.

In the invention, the dispersion in which particles including at least resin particles are dispersed is prepared by admixing the above-described dispersion of resin particles with the above-described dispersion of the colorant or the additional component. By heating the thus prepared dispersion to a temperature within a range from room temperature to the grass transition point of the resin, aggregation occurs between the resin particles and the colorant particles to form aggregated particles. The average particle size of the aggregated particles preferably ranges from 3 to 7 $\mu$m.

If the dispersion of resin particles is admixed with the dispersion of colorant particles, the resin particles are contained at 40% or less by mass, and preferably at about 2 to 20% by mass, while the colorant particles are contained at 50% or less by mass, and preferably at about 2 to 40% by mass. The additional component (particle) may be included in an amount not to adversely affect the objects of the invention, usually in a very small amount. Specifically, the additional component is contained at about 0.01 to 5% by mass, preferably at 0.5 to 2% by mass.

The toner for developing an electrostatic latent image used in the invention has a structure in which the aggregated particles serving as mother particles are provided with a coating layer made of the above-described fine particles (additional particles) on the surface thereof in case the adhering step is performed. The layer of the fine particles (additional particles) may be a mono-layer or a multi-layer. In general, the number of the layers is equal to the number of times of the adhering steps conducted in the process of producing the toner for developing an electrostatic latent image of the invention.

Next, the resultant mixture containing the aggregated particles is heated to a temperature above the softening point of the resin, usually at 70 to 120° C. such that the aggregated particles may cause fusion or coalescence to prepare a solution containing toner particles (a toner particle dispersion).

Then, the thus prepared solution containing toner particles is subjected to centrifugation or suction filtration to separate the toner particles. The toner particles are washed with ion exchange water once to three times. Thereafter, the toner particles are filtrated, washed with ion exchange water once to three times followed by drying, to thus yield a toner for developing an electrostatic latent image of the invention.

The toner for developing an electrostatic latent image of the invention preferably has the absolute value of chargeability ranging from 20 to 50 $\mu$C/g, and more preferably ranging from 25 to 40 $\mu$C/g. If the value is less than 20 $\mu$C/g, background staining frequently occurs. If the value is more than 50 $\mu$C/g, image density is easily decreased. The toner for developing an electrostatic latent image preferably has a ratio of chargeability in summer to chargeability in winter ranging from 0.7 to 1.3. If the ratio is outside the above preferable range, there arise undesirable situations that the toner is largely affected by circumstances and lacks in stable chargeability.

The toner for developing an electrostatic latent image of the invention has a molecular weight distribution, which is expressed by a ratio (Mw/Mn) of the weight average molecular weight (Mw) to the number average molecular weight (Mn) measured by gel permeation chromatography, preferably ranging from 2 to 30, more preferably ranging from 3 to 20. If the molecular weight distribution expressed by the ratio (Mw/Mn) is more than 30, light transmission and colorability are insufficient. Particularly when the toner is fixed onto a film, an image projected by light transmission is unclear and dark, or otherwise light is not transmitted through the film so that the projected image does not develop color. If less than 2, the viscosity of the toner at the time of fixing the toner at high temperatures seriously decreases, whereby offset phenomena are likely to occur. In contrast, if the molecular weight distribution expressed by the ratio (Mw/Mn) falls within the above-described range, light transmission and colorability are sufficient. Moreover, the viscosity of the toner at the time of fixing the toner at high temperatures is prevented from decreasing, whereby offset phenomena can effectively inhibited from occurring.

The toner for developing an electrostatic latent image is excellent in a variety of properties such as chargeability, developability, transferability and cleanability, and particularly cleanability over a long period of time. Further, the toner stably exhibits and maintains various performances without being affected by environmental conditions and hence the toner is very reliable. Since the toner for developing an electrostatic latent image is produced by the above-described process, the toner has a small average particle size and establishes a sharp particle size distribution, which is distinguishable from the toner obtained by employing a kneading and pulverizing process.

To the surface of the toner for developing an electrostatic latent image which is finally obtained by heating, as described above, may be added as the auxiliary for increasing fluidity or cleanability, inorganic minute particles such as silica, alumina, titania and calcium carbonate or resin fine particles made of vinyl resin, polyester, silicone or the like in a dry state under a shear force. As the inorganic minute particles, any inorganic particles that are conventionally used as the additive to be added to the exterior (surface) of the toner, such as silica, alumina, titania, calcium carbonate, magnesium carbonate, tricalcium phosphate and cerium oxide particles may be used. As the organic particles, any organic particles that are conventionally used as the additive to be added to the exterior (surface) of the toner, such as vinyl resin, polyester resin and silicone resin particles may be used. These inorganic particles and organic particles can be used as the auxiliary for enhancing fluidity, cleanability and the like. Examples of the lubricant include aliphatic acid amides such as ethylene bisstearic amide and oleic amide; and aliphatic acid metal salts such as zinc stearate and calcium stearate.

Developer

The composition of the developer for developing an electrostatic latent image of the invention is not limited so long as the developer contains the above-described toner. The developer for developing an electrostatic latent image of the invention may be prepared, for example, as a single-component developer for developing an electrostatic latent image containing a toner alone, or as a two-component developer for developing an electrostatic latent image containing a toner and a carrier in combination.

The carrier for use in the developer is not particularly limited, and may be selected from conventionally known carriers, for example, a carrier coated with a resin as disclosed in JP-A Nos. 62-39879 and 56-11461. The blending ratio of the toner for developing an electrostatic latent image of the invention and the carrier in the developer for developing an electrostatic latent image is not particularly limited and may be appropriately selected depending on the purposes.

Fixing Device

Hereinafter, the structure of a fixing device used in the invention is described in detail. The device illustrated below is merely an example, and is not particularly limited insofar as the fixing device falls within the scope of the appended claims. In the following description, a "heat-fixing roller" may be referred to merely as a "fixing roller".

FIG. 1 is a side sectional view showing an example of a fixing device of the invention. The device is composed mainly of a fixing roller 10, an endless belt 11, and a pressure pad (pressure member) 12 which is pressed against the fixing roller 10 via the endless belt 11.

The fixing roller 10 is composed of a heat-resistant elastic layer 10*b* and a releasing layer (heat-resistant resin layer) 10*c* formed on the circumference of a core (cylindrical core metal) 10*a* made of a metal. Inside the core 10*a*, a halogen lamp 14 is arranged as a heating source. The temperature of the surface of the fixing roller 10 is measured by a temperature sensor 15. The signals obtained by the measurement is feed-backed to the halogen lamp 14 through a temperature controller (not shown), whereby the surface of the fixing roller 10 is adjusted to maintain a constant temperature. The endless belt 11 is wound around the roller 10 at a given angle and in contact with the fixing roller 10 to thereby produce a nip.

The pressure pad 12 is arranged inside the endless belt 11 such that the pressure pad 12 is pressed against the fixing roller 10 via the endless belt 11. The pressure pad 12 is composed of an elastic member 12*a* so as to secure a large nip and a low friction layer 12*b* on the elastic member 12*a* in contact with the inner circumferential face of the endless belt 11, and the pad 12 is held by a holder 12*c* made of a metal or the like. The elastic member 12*a* having, on the surface thereof, the low friction layer 12*b* has a concave shape substantially in conformity with the outer circumferential face of the fixing roller 10, and is pressed against the fixing roller to produce the nip and generate a specific magnitude of distortion in the fixing roller 10. A belt traveling guide 13 is fixed to the holder 12*c* in such a manner that the endless belt 11 may slide and rotate smoothly. The belt traveling guide 13 is desirably a member having a low friction coefficient to render the guide 13 to adequately slide on the inner face of the endless belt 11. Further, the guide 13 is desirably a member having a low thermal conductivity in order not to absorb heat from the endless belt 11.

The fixing roller 10 is allowed to rotate in the direction represented by an arrow B driven by a motor (not shown). Following the rotation of the roller, the endless belt 11 rotates. Using a transferring device (not shown), a toner image 17 is transferred onto a recording sheet 16. This recording sheet 16 is fed from the right side shown in the drawing toward the nip (in the direction represented by an arrow A). The recording sheet 16 is inserted into the nip to allow the toner image fixed thereto, by pressure applied to the nip and heat conducted via the fixing roller 10 from the halogen lamp 14. When image-fixing is performed using the device having the structure illustrated in FIG. 1, stable fixing performance can be secured since the nip can be ensured large.

By the action of the releasing layer 10*c* and the distortion at the nip, the recording sheet 16 is effectively peeled off after image-fixing without being wound-up around the fixing roller 10. It is desirable to place, as a means to assist peeling, a releasing means 18 at the downstream of the nip in the direction along which the fixing roller 10 rotates. The releasing means 18 is held by a guide 18*b* such that a releasing sheet 18*a* is brought into contact with the fixing roller 10 in the direction reverse to the rotating direction of the fixing roller 10.

The respective members will be described in more detail hereinafter. As the core 10*a*, a cylindrical body made of a metal having a high thermal conductivity, such as aluminum or stainless steel, can be used. In the fixing device of the invention, a cylindrical body having a small outer diameter and a small thickness can be used as the core 10*a* since the pressing force exerted by the pressure pad 12 is small. Specifically, if the core 10*a* made of iron is used, the outer diameter thereof may range from about 20 to 40 mm and the thickness thereof may range from about 0.3 to 0.7 mm. Of course, an optimal size may appropriately be specified since the core has different strengths and thermal conductivity depending on the materials used.

The material to be used for the heat-resistant elastic layer 10*b* provided on the surface of the core 10 *a* may be any material if the material is an elastic material having a high heat-resistance. It is particularly preferable to use an elastic material (e.g., rubber and elastomer) having a rubber hardness ranging from 15 to 40° (JIS-A). Specific examples of the elastic material include silicone rubber and fluorine-containing rubber. Among the elastic materials, PFA is the most suitable material from the viewpoints of heat-resistance and workability. The thickness of the heat-resistant elastic layer 10*b* depends on the rubber hardness of the used material, and preferably ranges from 0.2 to 1.0 mm. If the thickness is below this range, sufficient distortion cannot be obtained. If the thickness is over this range, the duration necessary to warm-up is prolonged and high-speed adaptability is poor.

In the fixing device used in the invention, the nip is large and sufficient fixing performance can be obtained. Additionally, sufficient releasing property can be obtained at a small magnitude of distortion. Thus, the total load applied by the pressure pad 12 may be made decreased. Further, the heat-resistant elastic layer 10*b* can be thinned.

As described above, the fixing device of the invention has a decreased outer diameter and a decreased thickness of the core 10*a*. Furthermore, the heat-resistant elastic layer 10*b* formed on the surface of the core 10*a* can be thinned. Therefore, when compared with the conventional fixing devices having a pair of rolls, the heat capacity can be enlarged and the instant-start ability can be improved. In addition, the output of the halogen lamp 14 used as the heating source can be lowered, and the heat resistance between the inner face and the outer face of the fixing roller 10 can also be lowered, whereby heat responsibility can be accelerated. Accordingly, power consumption can be reduced and rapid image-fixing can be attained.

The resin to be used in the releasing layer (heat-resistant resin layer) 10*c* formed on the heat-resistant elastic layer 10*b* may be any resin insofar as it is heat-resistant. Examples of the resin include fluorine-containing resins and silicone resins. In consideration of the releasing property and abrasion-resistance of the releasing layer 10*c*, a fluorine-containing resin is preferably used. Examples of the fluorine-containing resin include PFA (perfluoroalkyl vinyl ether copolymer resin), PTFE (polytetrafluoroethylene) and FEP (tetrafluoroethylene hexafluoropropylene copolymer resin). Among them, PFA is the most preferable from the viewpoints of heat-resistance and workability. The thickness of the releasing layer 10*c* preferably ranges from 5 to 30 $\mu$m, more preferably from 10 to 20 $\mu$m. If the thickness of the releasing layer 10*c* is less than 5 $\mu$m, wrinkles resulting from distortion in the fixing roller may readily be generated. If the thickness is more than 30 $\mu$m, the releasing layer 10*c* becomes hard, leading to image defects such as non-uniform gloss. Thus, the thickness outside the above range is not preferable. In order to form the releasing layer 10*c*, any known method may be adopted.

The endless belt 11 is preferably composed of a base layer and a releasing layer which covers the surface(s) (the surface to contact with the fixing roll 10 or the both surfaces) of the base layer. The base layer is made of the material selected from polyimide, polyamide, polyamideimide and soon. The thickness thereof preferably ranges from about 50 to 125 $\mu$m, more preferably from about 75 to 100 $\mu$m. The releasing layer formed on the surface(s) of the base layer is preferably a coating layer made of the above-described fluorine-containing resin, for example, PFA, and having a thickness of 5 to 20 $\mu$m.

The angle at which the endless belt 10 is wound around the fixing roller 10, which depends on the rotating speed of the fixing roll 10, preferably ranges from about 20 to about 45° such that a large nip can be secured. Since the endless belt 11 travels following the shape of the fixing roll 10, the width of the nip can be enlarged, whereby the fixing property and the releasing property of the toner can be enhanced.

As described above, the pressure pad 12 is composed of the elastic member 12*a*, the low fraction layer 12*b* and the holder 12*c*. As the elastic member 12*a*, an elastic material, a blade spring and the like that are described supra in connection with the heat-resistant elastic layer 10*b* of the fixing roller 10 may be used. The member 12*a* has a concave shape which substantially follows the outer circumferential face of the fixing roller 10. The low friction layer 12*b* is disposed on the elastic member 12*a* to reduce sliding resistance between the inner circumferential face of the endless belt 11 and the pressure pad 12, desirably having a small friction coefficient and good abrasion-resistance. Specifically, a glass fiber sheet impregnated with Teflon (trade name), a fluorine-containing resin sheet, resins that are described supra in connection with the releasing layer 10*c* of the fixing roller 10 and the like may be used.

The pressure pad 12 is pressed against the fixing roller 10 to produce a nip and generate a specified magnitude of distortion against the fixing roller 10. The total load of the pressure pad 12 is not particularly limited insofar as a desired magnitude of distortion can be obtained. Since the nip is ensured to be large in the fixing device of the invention, a sufficient magnitude of distortion can be obtained, even at a small total load applied, if the load is gradually enlarged from the inlet to the outlet of the nip.

Image Forming Process

The image forming process of the invention comprises the steps of: forming a latent image on a surface of an electrostatic latent image-bearing body; developing the latent image with a toner for developing an electrostatic latent image to form a toner image; transferring the toner image onto a receiving body; and fixing the toner image to the receiving body. The process may further comprise a cleaning step.

The latent image forming step is a step of forming an electrostatic latent image on an electrostatic latent image-bearing body. The developing step is a step of developing the electrostatic latent image with a developer layer present on a developer-bearing body to thereby form a toner image. The developer layer is not particularly limited insofar as it contains the toner for developing an electrostatic latent image used in the invention. The transferring step is a step of transferring the toner image onto a receiving body. The cleaning step is a step of removing the developer for developing the electrostatic latent image that remains on the electrostatic latent image-bearing body.

In a preferable embodiment, the image forming process of the invention may further comprise the step of re-cycling. The re-cycling step is a step of transferring the toner for developing the electrostatic latent image, that is collected in the cleaning step, to the developer-bearing body.

The image forming process according to an embodiment of the invention comprising the re-cycling step can be carried out by using an image forming apparatus such as a copying machine or a facsimile of a toner re-cycling system type, and may be applied to a re-cycling system in which any cleaning step is omitted and a toner is collected simultaneously with developing images.

The respective steps are conventionally known per se, and the latent image-forming step is described in, for example, JP-A Nos. 56-40868 and 49-91231. Specifically, a laser ray is used to form an electrostatic latent image on an organic photoreceptor, and a developer supplied inside a developing device is used to develop the latent image. Then, the toner image formed on the latent image-bearing body is electrostatically transferred to a receiving body by means of a transferring roll, a corotron or the like. If necessary, the transferring step may be performed a plural number of times.

The image forming process of the invention can be carried out using a conventionally known image forming apparatus such as a copying machine or a facsimile. In the image forming process of the invention, the above-described toner for developing an electrostatic latent image and the above-described fixing device are used in combination. In other words, by fixing a highly reliable toner (the toner capable of maintaining good chargeability over a long period of time and preventing adhesion of the toner to a carrier or a photoreceptor by controlling the shape of the toner or the exposure ratio of the releasing agent at the toner surface) using a highly reliable fixing device (the device capable of producing a high releasing property and excellent image quality without posing problems of generating wrinkles in the releasing layer of the fixing roller, abrasion and deterioration resulting from friction, and a decrease in releasing property), it is possible to provide an image forming process capable of achieving instant-start ability, high image quality and high reliability as well as maintaining the performances over a long period of time.

EXAMPLES

The present invention will be described hereinafter by way of Examples, but the invention is not limited to these examples. All "part(s)" in the following description are by mass unless otherwise indicated.

Preparation of a Dispersion of Resin Particles 320 parts of styrene (manufactured by Wako Pure Chemical Industries, Ltd.), 80 parts of n-butyl acrylate (manufactured by Wako Pure Chemical Industries, Ltd.), 9 parts of β-carboxyethyl acrylate (manufactured by Rhodia Nicca, Ltd.), 1.5 part of 1,10-decandiol diacrylate (manufactured by Shin-Nakamura Chemical Co., Ltd.) and 2.7 parts of dodecanethiol (manufactured by Wako Pure Chemical Industries, Ltd.) are mixed and the resultant mixture is dispersed and emulsified in a solution in which 4 g of an anionic surfactant Dowfax (manufactured by Rhodia) is dissolved in 550 g of ion exchange water in a flask. To the resultant emulsified dispersion is added 50 g of ion exchange water in which 6 g of ammonium persulfate is dissolved with slowly stirring for 10 minutes. The system is completely replaced with nitrogen. Then, the flask is heated using an oil bath with stirring until the temperature inside the system reaches 70° C. The system is maintained at this temperature for 5 hours to continue emulsion polymerization.

As a result, a dispersion of anionic resin particles is prepared, which has the central particle size of 210 nm, the solid content of 43% by mass, the glass transition point of 51.0° C. and the weight average molecular weight of 30,000.

Preparation of a Dispersion of Colorant Particles (1)

50 g of a phthalocyanine pigment (PVFASTBLUE, manufactured by Dainichiseika Color & Chemicals Mfg. Co., Ltd.), 10 g of an anionic surfactant (Neogen SC, manufactured by Dai-ichi Kogyo Seiyaku Co., Ltd.) and 240 g of ion exchange water are admixed using a homogenizer (Ultra Talax T50, manufactured by IKA Co.) to disperse the pigment for 10 minutes, and then the resultant mixture is subjected to a circulating type ultrasonic dispersing machine (RUS-600TCVP, manufactured by Nippon Seiki Seisakusho) to produce a dispersion of colorant particles (1). The average particle size of the colorant particles in the dispersion (1) is 150 nm, and the number ratio of the particles having a particle size below 0.03 μm is 4%, and that of the particles having a particle size over 0.5 μm is 0.5%.

Preparation of a Dispersion of Colorant Particles (2)

50 g of carbon black (R330, manufactured by Cabot Corporation), 10 g of an anionic surfactant (Neogen SC, manufactured by Dai-ichi Kogyo Seiyaku Co., Ltd.) and 240 g of ion exchange water are admixed to prepare a dispersion of colorant particles (2) under the same conditions as in the preparation of the dispersion (1). The average particle size of the colorant particles in the dispersion (2) is 155 nm, and the number ratio of the particles having a particle size below 0.03 μm is 5%, and that of the particles having a particle size over 0.5 μm is 0.5%.

Preparation of a Dispersion of Colorant Particles (3)

50 g of C. I Pigment Red 122 (ECR-185, manufactured by Dainichiseika Color & Chemicals Mfg. Co., Ltd.), 10 g of an anionic surfactant (Neogen SC, manufactured by Dai-ichi Kogyo Seiyaku Co., Ltd.) and 240 g of ion exchange water are admixed to prepare a dispersion of colorant particles (3) under the same conditions as in the preparation of the dispersion (1). The average particle size of the colorant particles in the dispersion (3) is 165 nm, and the number ratio of the particles having a particle size of 0.03 μm or less is 6.0%, and that of the particles having a particle size of 0.5 μm or more is 0.5%.

Preparation of a Dispersion of Colorant Particles (4)

50 g of C. I Pigment Red 185 (manufactured by Clariant), 10 g of an anionic surfactant (Neogen SC, manufactured by Dai-ichi Kogyo Seiyaku Co., Ltd.) and 240 g of ion exchange water are admixed to prepare a dispersion of colorant particles (4) under the same conditions as in the preparation of the dispersion (1). The average particle size of the colorant particles in the dispersion (4) is 170 nm, and the number ratio of the particles having a particle size below 0.03 μm is 7.0%, and that of the particles having a particle size over 0.5 μm is 0.5%.

Preparation of a Dispersion of Colorant Particles (5)

50 g of C. I Pigment Yellow 74 (manufactured by Clariant), 10 g of an anionic surfactant (Neogen SC, manufactured by Dai-ichi Kogyo Seiyaku Co., Ltd.) and 240 g of ion exchange water are admixed to prepare a dispersion of colorant particles (5) under the same conditions as in the preparation of the dispersion (1). The average particle size of the colorant particles in the dispersion (5) is 175 nm, and the number ratio of the particles having a particle size below 0.03 μm is 6.0%, and that of the particles having a particle size over 0.5 μm is 0.3%.

Preparation of a Dispersion of a Releasing Agent 50 g of polyethylene wax (PW725, manufactured by Toyo-Petrolite), 10 g of an anionic surfactant (Neogen SC, manufactured by Dai-ichi Kogyo Seiyaku Co., Ltd.) and 240 g of ion exchange water are admixed using a homogenizer (Ultra Talax T50, manufactured by IKA Co.) to disperse the wax for 10 minutes, followed by additional dispersing treatment using a pressure-jet type homogenizer to yield a dispersion of releasing agent particles having a central particle size of 200 nm.

Production of Toner Particles 1

(Aggregating Step)

Into a round stainless steel flask are charged 500 g of ion exchange water, 250 g of the dispersion of resin particles, 36 g of the dispersion of colorant particles (1), 56 g (corresponding to 8.2% by mass) of the dispersion of the releasing agent, 10 g of the dispersion of inorganic minute particles (Snowtex OL, manufactured by Nissan Chemical industries Ltd.), 10 g (corresponding totally to 2% by mass) of the dispersion of inorganic minute particles (Snowtex OS, manufactured by Nissan Chemical industries Ltd.) and 0.5 g of a metal salt flocculant (polyvinyl aluminum, manufactured by Asada Kagaku Co.), and the resultant mixture is dispersed using a homogenizer (Ultra Talax T50, manufactured by IKA Co.). At the time of charging the materials, the dispersion of resin particles, the dispersion of colorant particles and the dispersion of the releasing agent are divided into three portions, respectively, to perform the mixing stepwise. Then, the flask is heated to 50° C. using an oil bath for heating with stirring. After the system is maintained at 50° C. for 60 minutes, the particle size is measured using Coulter Counter (Multisizer 2, manufactured by Beckman Coulter, Inc.) to find that aggregated particles having a particle size of 4.5 μm are produced. Then, the temperature of the oil bath for heating is further raised and the system is maintained at 52° C. for 1 hour. The particle size is measured to confirm that aggregated particles having a particle size of 5.0 μm are produced.

(Adhering Step)

To this dispersion containing the aggregated particles is slowly added 60 g of the dispersion of resin particles. Then, the temperature of the oil bath for heating is further raised and the system is maintained at 54° C. for 1 hour. The particle size of the resultant particles adhered by resin particles is measured and found to be 5.8 μm.

(Coalescence Step)

To the resultant mixture is added a 1 mol/L aqueous sodium hydroxide solution until the pH reaches 6.0. Thereafter, the stainless steel flask is air-tightly sealed and the system is slowly heated to 85° C. with stirring continued using a magnetic seal. The system is maintained at 85° C. for 60 minutes and then heated to 96° C., to which a 1 mol/L aqueous nitric acid solution is added to bring the pH to 5.0. The system is allowed to stand for 5 hours. Thereafter, the system is cooled, filtrated, washed 5 times with ion exchange water and then dried using a vacuum drier, to thus yield toner particles 1.

Production of Toner Particles 2

(Aggregating Step)

The same materials are used except that the dispersion of colorant particles (1) in the production of the toner particles 1 is replaced by 36 g of the dispersion of colorant particles (2). The materials are mixed and dispersed in a round stainless steel flask using a homogenizer (Ultra Talax T50, manufactured by IKA Co.) in the same way as in the production of the toner particles 1. Thereafter, the flask is heated to 50° C. using an oil bath for heating with stirring. The system is maintained at 50° C. for 60 minutes, and then the particle size is measured using Coulter Counter (Multisizer 2, manufactured by Beckman Coulter, Inc.) to find that aggregated particles having a particle size of 4.8 μm are produced. Then, the temperature of the oil bath for heating is further raised and the system is maintained at 52° C. for 1 hour. The particle size is measured to confirm that aggregated particles having a particle size of 5.0 μm are produced.

(Adhering Step)

To the thus prepared dispersion containing the aggregated particles is slowly added 60 g of the dispersion of resin particles. Then, the temperature of the oil bath for heating is further raised and the system is maintained at 54° C. for 1 hour. The particle size of the resultant particles adhered by resin particles is measured and found to be 5.2 μm.

(Coalescence Step)

To the resultant mixture is added a 1 mol/L aqueous sodium hydroxide solution until the pH reaches 6.0.

Thereafter, the stainless steel flask is sealed and the system is slowly heated to 85° C. with stirring continued using a magnetic seal. The system is maintained at this temperature for 60 minutes and then heated to 96° C., to which a 1 mol/L aqueous nitric acid solution is added to bring the pH to 5.0. The system is allowed to stand for 5 hours. Thereafter, the system is cooled, filtrated, washed 5 times with ion exchange water and then dried using a vacuum drier, to thus give toner particles 2.

Production of Toner Particles 3

(Aggregating Step)

The same materials are used except that the dispersion of colorant particles (1) in the production of the toner particles 1 is replaced by 18 g of the dispersion of colorant particles (3). The materials are placed into a round stainless steel flask using a homogenizer (Ultra Talax T50, manufactured by IKA Co.) in the same way as in the production of the toner particles 1. Thereafter, the flask is heated to 50° C. using an oil bath for heating with stirring. The system is maintained at 50° C. for 60 minutes, and then the particle size is measured using Coulter Counter (Multisizer 2, manufactured by Beckman Coulter, Inc.) to find that aggregated particles having a particle size of 4.7 μm are produced. Then, the temperature of the oil bath for heating is further raised and the system is maintained at 52° C. for 1 hour. The particle size is measured to confirm that aggregated particles having a particle size of 4.9 μm are produced.

(Adhering Step)

To the thus prepared dispersion containing the aggregated particles is slowly added 60 g of the dispersion of resin particles. Then, the temperature of the oil bath for heating is further raised and the system is maintained at 54° C. for 1 hour. The particle size of the resultant particles adhered by resin particles is measured and found to be 5.1 μm.

(Coalescence Step)

To the resultant mixture is added a 1 mol/L aqueous sodium hydroxide solution until the pH reaches 6.0. Thereafter, the stainless steel flask is sealed and the system is slowly heated to 85° C. with stirring continued using a magnetic seal. The system is maintained at this temperature for 60 minutes and then heated to 96° C., to which a 1 mol/L aqueous nitric acid solution is added to bring the pH to 5.0. The system is allowed to stand for 5 hours. Thereafter, the system is cooled, filtrated, washed 5 times with ion exchange water and then dried using a vacuum drier, to thus afford toner particles 3.

Production of Toner Particles 4

(Aggregating Step)

The same materials are used except that the dispersion of colorant particles (1) in the production of the toner particles 1 is replaced by 36 g of the dispersion of colorant particles (5). The materials are mixed and dispersed in a round stainless steel flask using a homogenizer (Ultra Talax T50, manufactured by IKA Co.) in the same way as in the production of the toner particles 1. Thereafter, the flask is slowly heated to 40° C. using an oil bath for heating with stirring. The system is maintained at this temperature for 60 minutes. Thereafter, the system is heated to 50° C. The system is maintained at 50° C. for 60 minutes and then the particle size is measured using Coulter Counter (Multisizer 2, manufactured by Beckman Coulter, Inc.) to find that aggregated particles having a particle size of 4.9 μm are produced. Then, the temperature of the oil bath for heating is further raised and the system is maintained at 52° C. for 1 hour. The particle size is measured to confirm that aggregated particles having a particle size of 5.1 μm are produced.

(Adhering Step)

To the thus prepared dispersion containing the aggregated particles is slowly added 60 g of the dispersion of resin particles. Then, the temperature of the oil bath for heating is further raised and the system is maintained at 54° C. for 1 hour. The particle size of the resultant particles adhered by resin particles is measured and found to be 5.3 μm.

(Coalescence Step)

To the resultant mixture is added a 1 mol/L aqueous sodium hydroxide solution until the pH reaches 6.0. Thereafter, the stainless steel flask is sealed and the system is slowly heated to 85° C. with stirring continued using a magnetic seal. The system is maintained at this temperature for 60 minutes, to which a 1 mol/L aqueous nitric acid solution is added to bring the pH to 5.0. The system is heated to 96° C. and maintained at this temperature for 5 hours. Thereafter, the system is cooled, filtrated, washed 5 times with ion exchange water and then dried using a vacuum drier, to thus yield toner particles 4.

Production of Toner Particles 5

(Aggregating Step)

The same materials are used except that the amount of the dispersion of resin particles and that of the dispersion of the releasing agent are changed to 250 g and 135 g (corresponding to 19.8% by mass), respectively, in the production of the toner particles 1. The materials are mixed and dispersed in a round stainless steel flask using a homogenizer (Ultra Talax T50, manufactured by IKA Co.) in the same way as in the production of the toner particles 1. Thereafter, the flask is heated to 50° C. using an oil bath for heating with stirring. The system is maintained at 50° C. for 60 minutes. Thereafter, the particle size is measured using Coulter Counter (Multisizer 2, manufactured by Beckman Coulter, Inc.) to find that aggregated particles having a particle size of 4.8 μm are produced. Then, the temperature of the oil bath for heating is further raised and the system is maintained at 52° C. for 1 hour. The particle size is measured to confirm aggregated particles having a particle size of 5.0 μm produced.

(Adhering Step)

To the thus prepared dispersion containing the aggregated particles is slowly added 60 g of the dispersion of resin particles. Then, the temperature of the oil bath for heating is further raised and the system is maintained at 54° C. for 1 hour. The particle size of the resultant particles adhered by resin particles is measured and found to be 5.2 μm.

(Coalescence Step)

To the resultant mixture is added a 1 mol/L aqueous sodium hydroxide solution until the pH reaches 6.0. Thereafter, the stainless steel flask is sealed and the system is slowly heated to 85° C. with stirring continued using a magnetic seal. The system is maintained at this temperature for 60 minutes and then heated to 96° C., to which a 1 mol/L aqueous nitric acid solution is added to bring the pH to 4.8. Then, the system is allowed to stand for 5 hours. Thereafter, the system is cooled, filtrated, washed 5 times with ion exchange water and then dried using a vacuum drier, to thus give toner particles 5.

Production of Toner Particles 6

(Aggregating Step)

The same materials are placed into a round stainless steel flask. The materials are mixed using a homogenizer (Ultra Talax T50, manufactured by IKA Co.) in the same way as in the production of the toner particles 1. Thereafter, the flask is heated to 50° C. using an oil bath for heating with stirring. The system is maintained at 50° C. for 60 minutes. Thereafter, the particle size is measured using Coulter Counter (Multisizer 2, manufactured by Beckman Coulter, Inc.) to find aggregated particles having a particle size of 4.9 μm produced. Then, the temperature of the oil bath for heating is further raised and the system is maintained at 52° C. for 1 hour. The particle size is measured to confirm aggregated particles having a particle size of 5.1 μm produced.

(Adhering Step)

To the thus prepared dispersion containing the aggregated particles is slowly added 60 g of the dispersion of resin particles. Then, the temperature of the oil bath for heating is further raised and the system is maintained at 54° C. for 1 hour. The particle size of the resultant particles adhered by resin particles is measured and found to be 5.3 μm.

(Coalescence Step)

To the resultant mixture is added a 1 mol/L aqueous sodium hydroxide solution until the pH reaches 6.0. Thereafter, the stainless steel flask is sealed and the system is slowly heated to 85° C. with stirring continued using a magnetic seal. The system is maintained at this temperature for 60 minutes and then heated to 96° C., to which a 1 mol/L aqueous nitric acid solution is added to bring the pH to 5.5. The system is allowed to stand for 10 hours. Thereafter, the system is cooled, filtrated, washed 5 times with ion exchange water and then dried using a vacuum drier, to thus give toner particles 6.

Production of Toner Particles A (GSD is Outside the Specified Range)

(Aggregating Step)

The same materials are used except that the amount of the ion exchange water is changed to 800 g and polyvinyl aluminum used as a metal salt flocculant is replaced by 0.5 g of iron chloride (III) in the production of the toner particles 1. The materials are mixed and dispersed in a round stainless steel flask using a homogenizer (Ultra Talax T50, manufactured by IKA Co.) in the same way as in the production of the toner particles 1. Thereafter, the flask is heated to 52° C. using an oil bath for heating with stirring. The system is maintained at 52° C. for 60 minutes. Thereafter, the particle size is measured using Coulter Counter (Multisizer 2, manufactured by Beckman Coulter, Inc.) to find aggregated particles having a particle size of 4.9 μm produced. Then, the temperature of the oil bath for heating is further raised and the system is maintained at 54° C. for 1 hour. The particle size is measured to confirm aggregated particles having a particle size of 5.1 μm produced.

(Adhering Step)

To the thus prepared dispersion containing the aggregated particles is slowly added 60 g of the dispersion of resin particles. Then, the temperature of the oil bath for heating is further raised and the system is maintained at 55° C. for 1 hour. The particle size of the resultant particles adhered by resin particles is measured and found to be 5.3 μm.

(Coalescence Step)

To the resultant mixture is added a 1 mol/L aqueous sodium hydroxide solution until the pH reaches 6.0. Thereafter, the stainless steel flask is sealed and the system is heated to 96° C. with stirring continued using a magnetic sealer. A 1 mol/L aqueous nitric acid solution is added to the system to bring the pH to 5.0. The system is allowed to stand for 5 hours. Thereafter, the system is cooled, filtrated, washed 5 times with ion exchange water and then dried using a vacuum drier, to thus produce toner particles A.

Production of Toner Particles B (a Shape Coefficient SF1 is 140 or More, and a Shape Coefficient SF2 is 130 or More)

(Aggregating Step)

The same materials are mixed and dispersed in a round stainless steel flask using a homogenizer (Ultra Talax T50, manufactured by IKA Co.) in the same way as in the production of the toner particles 1. Thereafter, the flask is heated to 52° C. using an oil bath for heating with stirring. The system is maintained at 52° C. for 60 minutes. Thereafter, the particle size is measured using Coulter Counter (Multisizer 2, manufactured by Beckman Coulter, Inc.) to confirm aggregated particles having a particle size of 4.7 μm produced. Then, the temperature of the oil bath for heating is further raised and the system is maintained at 54° C. for 1 hour. The particle size is measured to confirm aggregated particles having a particle size of 4.9 μm produced.

(Adhering Step)

To the thus prepared dispersion containing the aggregated particles is slowly added 60 g of the dispersion of resin particles. Then, the temperature of the oil bath for heating is further raised and the system is maintained at 55° C. for 1 hour. The particle size of the resultant particles is measured and found to be 5.1 μm.

(Coalescence Step)

To the resultant mixture is added a 1 mol/L aqueous sodium hydroxide solution until the pH reaches 6.5. Thereafter, the stainless steel flask is sealed and the system is slowly heated to 96° C. with stirring continued using a magnetic sealer. A 1 mol/L aqueous nitric acid solution is added to the system to bring the pH to 6.0. The system is allowed to stand for 5 hours. Thereafter, the system is cooled, filtrated, washed 5 times with ion exchange water and then dried using a vacuum drier, to thus produce toner particles B.

Production of Toner Particles C (a Shape Coefficient SF1 is Less Than 125, and a Shape Coefficient SF2 is Less Than 105)

(Aggregating Step)

The same materials for producing the toner particles 1 are put into a round stainless steel flask. The materials are mixed and dispersed using a homogenizer (Ultra Talax T50, manufactured by IKA Co.) in the same way as in the production of the toner particles 1. Thereafter, the flask is heated to 52° C. using an oil bath for heating with stirring. The system is maintained at 52° C. for 60 minutes. Thereafter, the particle size is measured using Coulter Counter (Multisizer 2, manufactured by Beckman Coulter, Inc.) to find aggregated particles having a particle size of 4.7 μm produced. Then, the temperature of the oil bath for heating is further raised and the system is maintained at 54° C. for 1 hour. The particle size is measured to confirm aggregated particles having a particle size of 4.9 μm produced.

(Adhering Step)

To the thus prepared dispersion containing the aggregated particles is slowly added 60 g of the dispersion of resin particles. Then, the temperature of the oil bath for heating is further raised and the system is maintained at 55° C. for 1 hour. The particle size of the resultant particles adhered by resin particles is measured and found to be 5.1 μm.

(Coalescence Step)

To the resultant mixture is added a 1 mol/L aqueous sodium hydroxide solution until the pH reaches 6.0. Then, the stainless steel flask is sealed and the system is slowly heated to 96° C. with stirring continued using a magnetic seal, to which a 1 mol/L aqueous nitric acid solution is added to bring the pH to 5.4. The system is allowed to stand for 5 hours. Thereafter, the system is cooled, filtrated, washed 5 times with ion exchange water and then dried using a vacuum drier, to thus produce toner particles C.

Production of Toner Particles D (Having a Large Amount of Wax on the Surface Thereof)

(Aggregating Step)

The same materials for producing the toner particles 1 are used except that the amount of the dispersion of the releasing agent is changed to 146 g (corresponding to 21.5% by mass). The materials are mixed and dispersed in a round stainless steel flask using a homogenizer (Ultra Talax T50, manufactured by IKA Co.) in the same way as in the production of the toner particles 1. Thereafter, the flask is heated to 52° C. using an oil bath for heating with stirring. The system is maintained at 52° C. for 60 minutes. Thereafter, the particle size is measured using Coulter Counter (Multisizer 2, manufactured by Beckman Coulter, Inc.) to find aggregated particles having a particle size of 4.6 μm produced. Then, the temperature of the oil bath for heating is further raised and the system is maintained at 54° C. for 1 hour. The particle size is measured to confirm aggregated particles having a particle size of 4.8 μm produced.

(Adhering Step)

To the thus prepared dispersion containing the aggregated particles is slowly added 60 g of the dispersion of resin particles. Then, the temperature of the oil bath for heating is further raised and the system is maintained at 55° C. for 1 hour. The particle size of the resultant particles adhered by resin particles is measured and found to be 5.0 μm.

(Coalescence Step)

To the resultant mixture is added a 1 mol/L aqueous sodium hydroxide solution. Thereafter, the stainless steel flask is sealed and the system is slowly heated to 97° C. with stirring using a magnetic seal. The system is maintained at this temperature for 10 hours. Thereafter, the system is cooled, filtrated, washed 5 times with ion exchange water and then dried using a vacuum drier, to thus produce toner particles D.

Evaluation of the Toners for Developing an Electrostatic Latent Image

The respective toners, after dried, are evaluated for the following properties.

(1) a shape coefficient SF1: a value obtained by image analysis (calculated according to an equation: $SF1=(\pi/4)\times(L^2/A)\times100$ (wherein L represents a maximum length and A represents a projected area of toner particles));

(2) a shape coefficient SF2: a value obtained by image analysis (calculated according to an equation: $SF2=(\pi/4)\times(I^2/A)\times100$ (wherein I represents a circumferential length and A represents a projected area of toner particles));

(3) an exposure ratio of the releasing agent to the toner surface: quantified by CIS peak separation in X-ray photoelectron spectroscopy (XPS);

(4) the amount of the releasing agent charged: a charged amount at the time of producing each of the toners;

(5) the size of the releasing agent at a cross section of the toner: observed at a cross section of over 50 toner particles using a transmission electron microscopy (5,000 magnifications);

(6) volume particle size distribution index (GSDv): the square root of D84/D16 in the volume particle size distribution;

(7) number particle size distribution index (GSDp): the square root of D84/D16 in the number particle size distribution; and (8) small particle size side number distribution index (GSDp-under): D50/D16 in the number particle size distribution.

The results of evaluating produced toner particles 1 to 6 and toner particles A to D are shown in Table 1.

TABLE 1

| Toner | (1) SF 1 | (2) SF 2 | (3) Exposure ratio of the releasing agent | (4) Amount of the releasing agent charged | (5) Size of the releasing agent at a cross section of toner | (6) GSDv | (7) GSDp | (8) GSDp-under |
|---|---|---|---|---|---|---|---|---|
| Particle 1 | 131 | 107 | 24.6% | Corresponding to 8.2% by mass | 550 nm | 1.21 | 1.22 | 1.23 |
| Particle 2 | 130 | 107 | 18.9% | Corresponding to 8.2% by mass | 480 nm | 1.22 | 1.23 | 1.24 |
| Particle 3 | 130 | 109 | 21.4% | Corresponding to 8.2% by mass | 780 nm | 1.21 | 1.22 | 1.24 |
| Particle 4 | 135 | 115 | 32.8% | Corresponding to 8.2% by mass | 680 nm | 1.21 | 1.22 | 1.24 |
| Particle 5 | 139 | 122 | 38.7% | Corresponding to 19.8% by mass | 850 nm | 1.22 | 1.22 | 1.24 |
| Particle 6 | 126 | 106 | 37.5% | Corresponding to 8.2% by mass | 850 nm | 1.23 | 1.23 | 1.24 |
| Particle A | 131 | 107 | 22.6% | Corresponding to 8.2% by mass | 590 nm | 1.26 | 1.26 | 1.28 |
| Particle B | 141 | 131 | 25.0% | Corresponding to 8.2% by mass | 800 nm | 1.23 | 1.23 | 1.24 |
| Particle C | 124 | 104 | 24.1% | Corresponding to 8.2% by mass | 800 nm | 1.23 | 1.23 | 1.24 |
| Particle D | 135 | 115 | 42.5% | Corresponding to 21.5% by mass | 1550 nm | 1.21 | 1.22 | 1.24 |

Production of the Developers for Developing an Electrostatic Latent Image

To 50 g each of the toner particles 1 to 6 and tone particles A to D is added 0.65 g of hydrophobic silica (TS720, manufactured by Cabot Co.) and then blended in a sample mill, followed by 45-μm sieving. To the thus blended product weighing 5% by mass as a toner concentration is added a ferrite carrier coated with 1% by mass of polymethacrylate (manufactured by Sohken Kagaku Co.) and having an average particle size of 50 μm, in a V-shaped blender with stirring for 20 minutes. Then the resultant product is subjected to 177-μm sieving to give developers 1 to 6 and developers A to D for developing an electrostatic latent image.

Evaluation of Fixing Performance

Example 1

The developer 1 for developing an electrostatic latent image is subjected to a running test from an initial stage to a stage of 100,000 sheets of paper using an image forming apparatus (A-COLOR 630, a modified apparatus in which the fixing device described in an embodiment of the invention is mounted, manufactured by Fuji Xerox Co., Ltd.). The modified apparatus performs image-forming at two stages; that is, forming a latent image on an organic photoreceptor with a laser ray, and then transferring a toner image obtained by developing the latent image onto a receiving body (recording sheet).

The results indicate that the quality of the formed image is good at the initial stage, and the image quality does not deteriorate after the running test for the 100,000 sheets. The transferring efficiency is maintained 98% from the initial stage to the 100,000-sheet stage. The duration for the temperature of the fixing device raised to 180° C. from 25° C. is 45 seconds, to thereby confirm that instant-start ability is good. No problems are caused relating to light transmission of a resin sheet (OHP film) to which the toner is fixed.

Example 2

The developer 2 for developing an electrostatic latent image is subjected to a running test from an initial stage to a stage of 100,000 sheets of paper using an image forming apparatus (A-COLOR 630, a modified apparatus in which the fixing device described in an embodiment of the invention is mounted, manufactured by Fuji Xerox Co., Ltd.).

The results reveal that the quality of the formed image is good at the initial stage, and the image quality does not deteriorate after the running test for the 100,000 sheets. The transferring efficiency is maintained 98% from the initial stage to the 100,000-sheet stage. The duration for the temperature of the fixing device increased to 180° C. from 25° C. is 45 seconds, to thus show that instant-start ability is good. No problems are caused relating to light transmission of a resin sheet (OHP film) to which the toner is fixed.

Example 3

The developer 3 for developing an electrostatic latent image is subjected to a running test from an initial stage to a stage of 100,000 sheets of paper using an image forming apparatus (A-COLOR 630, a modified apparatus in which the fixing device described in an embodiment of the invention is mounted, manufactured by Fuji Xerox Co., Ltd.).

The results indicate that the quality of the formed image is good at the initial stage, and the image quality does not deteriorate after the running test for the 100,000 sheets. The transferring efficiency is maintained 98% from the initial stage to the 100,000-sheet stage. The duration for the temperature of the fixing device elevated to 180° C. from 25° C. is 45 seconds, to thus demonstrate that instant-start ability is good. No problems are caused relating to light transmission of a resin sheet (OHP film) to which the toner is fixed.

Example 4

The developer for developing an electrostatic latent image is subjected to a running test from an initial stage to a stage of 100,000 sheets of paper using an image forming apparatus (A-COLOR 630, a modified apparatus in which the fixing device described in an embodiment is mounted, manufactured by Fuji Xerox Co., Ltd.).

The results show that the quality of the formed image is good at the initial stage, and the image quality does not deteriorate after the running test for the 100,000 sheets. The transferring efficiency is maintained 98% from the initial stage to the 100,000-sheet stage. The duration for the temperature of the fixing device raised to 180° C. from 25° C. is 45 seconds, to thereby clarify that instant-start ability is good. No problems are caused relating to light transmission of a resin sheet (OHP film) to which the toner is fixed.

Example 5

The developer 5 for developing an electrostatic latent image is subjected to a running test from an initial stage to a stage of 100,000 sheets of paper using an image forming apparatus (A-COLOR 630, a modified apparatus in which the-fixing device described in an embodiment of the invention is mounted, manufactured by Fuji Xerox Co., Ltd.).

The results reveal that the quality of the formed image is good at the initial stage, and the image quality does not deteriorate after the running test for the 100,000 sheets. The transferring efficiency is maintained 98% from the initial stage to the 100,000-sheet stage. The duration for the temperature of the fixing device elevated to 180° C. from 25° C. is 45 seconds, to thereby show that instant-start ability is good. No problems are caused relating to light transmission of a resin sheet (OHP film) to which the toner is fixed.

Example 6

The developer 6 for developing an electrostatic latent image is subjected to a running test from an initial stage to a stage of 100,000 sheets of paper using an image forming apparatus (A-COLOR 630, a modified apparatus in which the fixing device described in an embodiment of the invention is mounted, manufactured by Fuji Xerox Co., Ltd.).

The results show that the quality of the formed image is good at the initial stage, and the image quality does not deteriorate after the running test for the 100,000 sheets. The transferring efficiency is maintained 98% from the initial stage to the 100,000-sheet stage. The duration for the temperature of the fixing device to reach 180° C. from 25° C. is 45 seconds. Thus, instant-start ability is revealed good. No problems are caused relating to light transmission of a resin sheet (OHP film) to which the toner is fixed.

Comparative Example 1

The developer A for developing an electrostatic latent image is subjected to a running test using an image forming apparatus (A-COLOR 630, a modified apparatus in which the fixing device described in an embodiment of the invention is mounted, manufactured by Fuji Xerox Co., Ltd.).

The resolution and the sharpness of images are poor from the initial stage. The transferring efficiency is 85%, and the quality of the images is adversely affected by the poor transferring property.

Comparative Example 2

The developer B for developing an electrostatic latent image is subjected to a running test using an image forming apparatus (A-COLOR 630, a modified apparatus in which the fixing device described in an embodiment of the invention is mounted, manufactured by Fuji Xerox Co., Ltd.).

The fluidity of the toner is low from the initial stage, whereby the conveying property of the toner is poor. The transferring efficiency is as low as 60%, leading to defective image quality.

Comparative Example 3

The developer C for developing an electrostatic latent image is subjected to a running test using an image forming apparatus (A-COLOR 630, a modified apparatus in which the fixing device described in an embodiment of the invention is mounted, manufactured by Fuji Xerox Co., Ltd.).

Image quality is good at the initial stage, but cleanability is poor when the running test for 1,000 sheets of paper is finished to thus degrade image quality, whereby the running test is halted.

Comparative Example 4

The developer D for developing an electrostatic latent image is subjected to a running test using an image forming apparatus (A-COLOR 630, a modified apparatus in which the fixing device described in an embodiment of the invention is mounted, manufactured by Fuji Xerox Co., Ltd.).

Since the chargeability of the toner is poor from the initial stage, fogging occurs and image quality is poor. Light transmission of a resin sheet (OHP film) to which the toner is fixed is poor and the toner is low in resin sheet adaptability.

According to the invention, there is provided an image forming process which has excellent properties such as chargeability, developability, transferability, fixing properties and particularly cleanability, satisfies high image quality, high reliability and sufficient maintaining ability, and makes it possible to stably perform an instant-on fixing, and further with which it is possible to produce a high quality image having excellent light transmission and colorability.

What is claimed is:

1. An image forming process comprising the steps of:

forming a latent image on a surface of an electrostatic latent image-bearing body;

developing the latent image with a toner for developing an electrostatic latent image to form a toner image;

transferring the toner image onto a receiving body; and fixing the toner image to the receiving body, wherein the step of fixing is carried out using a fixing device comprising a heat-fixing roller in which a heat-resistant elastic layer is provided on a cylindrical core metal and the resultant surface thereof is further provided with a heat-resistant resin layer, an endless belt, and a pressure member arranged inside the endless belt to allow the endless belt to travel around the heat-fixing roller at a given angle such that a nip is produced through which the receiving body passes, with the pressure member being pressed via the endless belt against the heat-fixing roller at the nip to thereby distort the heat-resistant elastic layer in the heat-fixing roller, and the toner for developing the electrostatic latent image satisfies the requirements of a) a shape coefficient SF1 ranges from 125 to 140 and a shape coefficient SF2 ranges from 105 to 130, wherein $SF1=(\pi/4)\times(L^2/A)\times100$ and $SF2=(1/4\pi)\times(I^2/A)\times100$, in which L represents a maximum length, I represents a circumferential length and A represents a projected area of toner particles, b) an exposure ratio of a releasing agent at the surface of the toner particles determined by X-ray photoelectron spectroscopy (XPS) ranges from 11 to 40%, and c) a melting point of the releasing agent contained at 8 to 20% by mass in the toner, measured with a differential scanning calorimeter, ranges from 70 to 130° C., and the size of the releasing agent determined at a cross section of the toner particle observed with a transmission electron microscope ranges from 150 to 1500 nm.

2. The process according to claim 1, wherein the thickness of the heat-resistant elastic layer ranges from 0.2 mm to 1.0 mm.

3. The process according to claim 1, wherein the distortion is expressed by the magnitude of a nip width of 3 to 12 mm of the heat-resistant elastic layer in the heat fixing roller.

4. The process according to claim 1, wherein the toner further satisfies requirements of d) an average volume particle size distribution index $GSDv\leqq1.25$, wherein $GSDv=(D84v/D16v)^{1/2}$, in which D84v is a particle size value at which accumulated volume from the side of a smaller particle size in the volume particle size distribution accounts for 84% and D16v is a particle size value at which accumulated volume from the side of a smaller particle size in the volume particle size distribution accounts for 16%, e) an average number particle size distribution index $GSDp\leqq1.25$, wherein $GSDp=(D84p/D16p)^{1/2}$, in which D84p is a particle size value at which accumulated number from the side of a smaller particle size in the number particle size distribution accounts for 84% and D16p is a particle size value at which accumulated number from the side of a smaller particle size in the number particle size distribution accounts for 16%, f) a small particle size side number particle size distribution index $GSDp\text{-under}\leqq1.27$, wherein $GSDp\text{-under}=(D50p/D16p)$, in which D50p is a particle size value at which accumulated number from the side of a smaller particle size in the number particle size distribution accounts for 50% and D16p is a particle size value at which accumulated number from the side of a smaller particle size in the number particle size distribution accounts for 16%, and g) inclusion of minute particles made of two or more kinds of silicon compounds, each having a central particle size of 5 to 30 nm and 30 to 100 nm, at 0.5 to 10% by mass.

5. The process according to claim 1, wherein the developing step is carried out using a developer for developing an electrostatic latent image comprising a carrier and a toner for developing the electrostatic latent image.

6. The process according to claim 1, wherein the heat-resistant resin layer comprises a fluorine-containing resin.

7. The process according to claim 1, wherein the thickness of the heat-resistant resin layer ranges from 10 to 50 μm.

8. The process according to claim 1, wherein the total pressing force exerted by the pressure member is 60 kg or less.

9. The process according to claim 1, wherein the toner is produced by admixing a dispersion containing at least resin fine particles having a particle size of 1 μm or less with a dispersion of colorant particles and a dispersion of a releasing agent to prepare a dispersion of aggregated particles, followed by heating the thus prepared dispersion to a temperature above the glass transition point of the resin fine particles.

10. The process according to claim 9, wherein the dispersion of aggregated particles is produced using a metal salt.

11. The process according to claim 9, wherein the toner is produced by further adding a dispersion of fine particles to the dispersion of aggregated particles to adhere the fine particles to the aggregated particles to thereby form particles adhered by the fine particles.

12. The process according to claim 11, wherein, in the step of adding the dispersion of fine particles to adhere the fine particles to the aggregated particles, the fine particles are resin fine particles.

13. The process according to claim 11, wherein the step of adding the dispersion of fine particles to adhere the fine particles to the aggregated particles is performed a plural number of times.

14. The process according to claim 9, wherein the average particle size of the colorant particles in the dispersion of colorant particles is 0.8 $\mu$m or less.

15. The process according to claim 14, wherein the number ratio of the colorant particles having a particle size over 0.8 $\mu$m in the dispersion of colorant particles is less than 10%.

16. The process according to claim 14, wherein the number ratio of the colorant particles having a particle size over 0.05 $\mu$m in the dispersion of colorant particles is less than 5%.

17. The process according to claim 1, wherein the toner for developing an electrostatic latent image has an absolute value of chargeability ranging from 20 to 50 $\mu$C/g.

18. The process according to claim 1, wherein the heat-resistant elastic layer has a rubber hardness ranging from 15 to 40° (JIS-A).

19. The process according to claim 1, wherein the endless belt comprises a base layer having disposed on a surface thereof a releasing layer.

20. The process according to claim 19, wherein the base layer is made of any one selected from polyimide, polyamide and polyamideimide, and the thickness thereof ranges from 50 to 125 $\mu$m.

* * * * *